United States Patent [19]

Craggs et al.

[11] 4,389,795

[45] Jun. 28, 1983

[54] PELTING BOARD

[76] Inventors: Harold B. Craggs, 7715 Robe Menzel Rd., Granite Falls, Wash. 98252; Leo Weisdorfer, 113309 SE. 272nd Ave., Boring, Oreg. 97009

[21] Appl. No.: 255,767

[22] Filed: Apr. 20, 1981

[51] Int. Cl.[3] ..... C14B 1/26

[52] U.S. Cl. ..... 34/103; 34/104; 34/239; 38/102; 69/19.2

[58] Field of Search ..... 38/102, 102.1, 102.2; 69/28, 29, 19.1, 19.2; 34/103, 104, 239

[56] References Cited

U.S. PATENT DOCUMENTS 1,110,016 9/1914 Thorpe ..... 69/19.2
1,866,709 7/1932 Horsting ..... 69/19.2
2,485,242 10/1949 Leighton ..... 69/19.2
3,313,038 4/1967 Bolz ..... 34/103

*Primary Examiner*—Larry I. Schwartz
*Attorney, Agent, or Firm*—Seed, Berry, Vernon & Baynham

[57] ABSTRACT

A novel pelting board removes the need for pins or other tack-like fasteners and allows for better drying of the pelts along edges of the board. The board's frame of non-absorbent plastic has channels along its edges, a dam to direct air to the channels, and a lattice of girders between the edges for improved airflow. Clips hook onto the lattice girders to hold the underside and tail. This pelting board allows faster drying with reduced sticking of the pelt to the board.

15 Claims, 4 Drawing Figures

PELTING BOARD

DESCRIPTION

1. Technical Field

This invention relates to a pelting board especially suitable for use in the fur out drying process of preparing mink pelts for the fur industry.

2. Background Art

The conventional pelt drying process ordinarily uses a flat wood slat to draw tautly a fresh pelt. Air is supplied between the pelt and the slat to enhance the drying. The wooden slats absorb moisture from the pelt and become sour quickly, requiring that the slat be replaced. Sometimes damage to the pelt itself occurs. In U.S. Pat. No. 3,313,038, a pelt drying frame of metal or other nonabsorbent material is used with air from an air supply manifold to dry expeditiously and practically a pelt. This frame employs a wooden plate to secure the underside and tail of the pelt to the frame with staples or thumbtacks. Thus, when the pelt dries and shrinks, sticking of the pelt to the frame may damage the pelt.

In U.S. Pat. No. 3,526,967, a pelt drying system for drying pelts fur side out is disclosed. The system uses a manifold having air discharge nozzles to supply temperature and humidity controlled air to drying frames through a common trunk line. The patent focuses upon a novel air-conditioning unit used to supply the air.

DISCLOSURE OF INVENTION

This invention improves over existing pelting board systems by removing the need for pinning the pelt to the frame. Additionally, the pelting board of this invention utilizes a plurality of channels near its edges to supply drying air to the edges of the frame so that the pelts dry more evenly in these areas and stick less often to the frame.

A preferred pelting board for drying pelts in a fur out pelting process is capable of tautly holding a pelt about it and comprises a generally flat, elongated, relatively narrow frame. The frame has a generally parabolic shape with channels created about its edges. A dam on one side of the frame directs drying air from an air nozzle to two channels along the edges of the frame. A lattice of girders between the edges of the frame allows for airflow throughout the length of the frame so that drying air contacts the pelt over substantially its entire inner surface. Plastic clips are used to hold the underside of the pelt and the tail on the frame. Each clip has a plurality of hooks extending upwardly from a lattice frame. These hooks hook around the lattice girders of the pelting board frame to hold the pelt firmly. The tail clip is preferably reversible with differently spaced hooks on either side. Differently spaced hooks are needed because a male pelt tail will usually be larger than that of a female.

BEST MODE FOR CARRYING OUT THE INVENTION

United States Patent 3,313,038 is incorporated by reference into this description, especially with respect to its discussion of pelting boards and a method of drying pelts.

Figure 1:
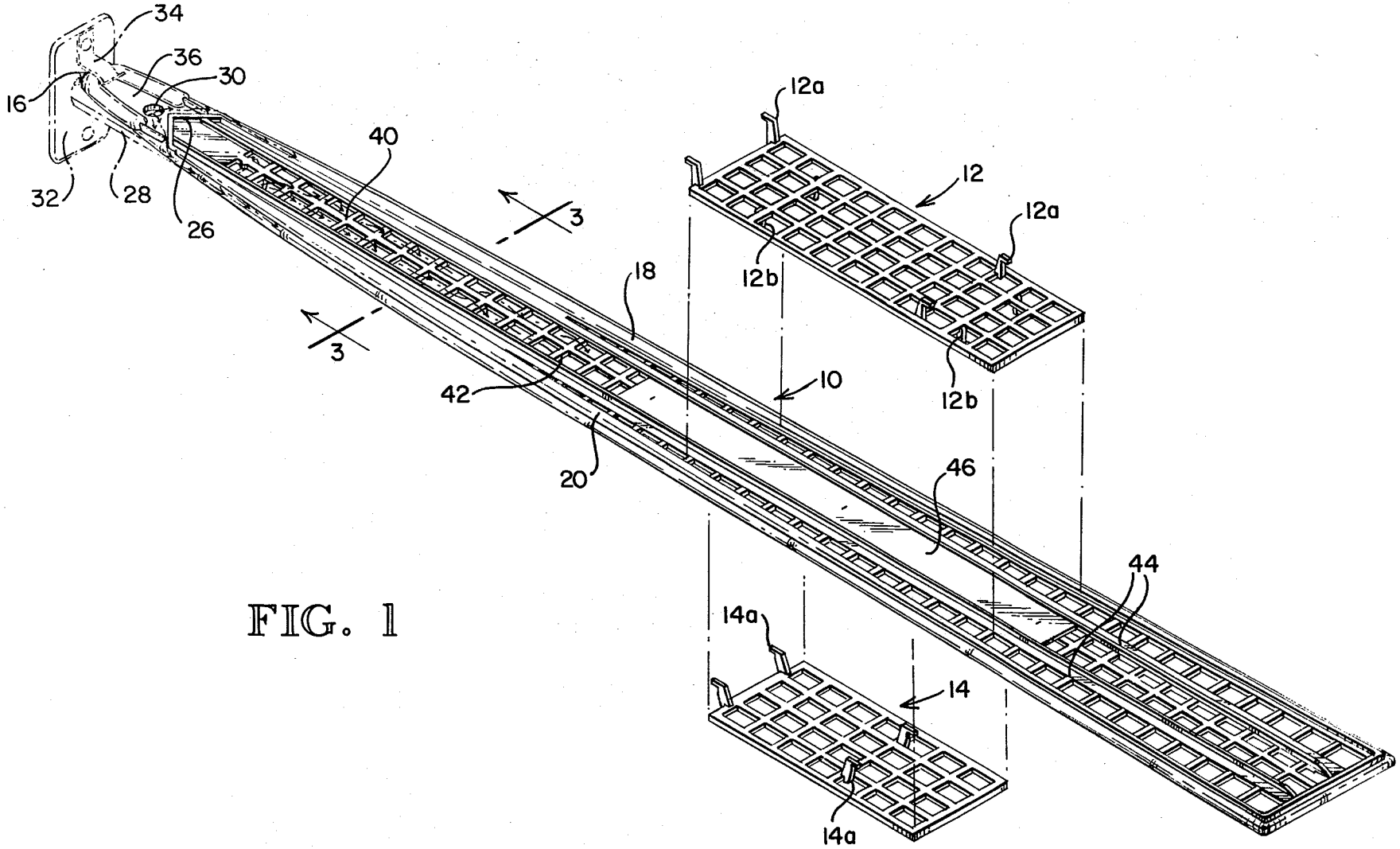
FIG. 1 shows a perspective view of a preferred pelting board.
Figure 3:
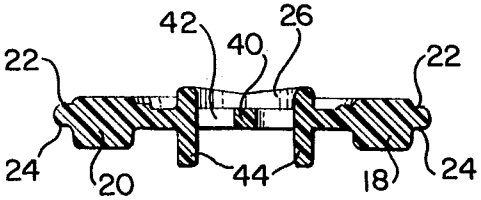
FIG. 3 is a cross-section of the pelting board of FIG. 1 taken along line 3—3.

The pelting board of this invention generally comprises three pieces: a frame 10, a tail clip 12, and an underside clip 14. The frame is generally made from an injection-molded plastic which is nonabsorbent to moisture from the pelt, or any other suitable nonabsorbent material. The frame is generally parabolic in shape, having a nose end with a pin point 16 which is used to secure the head of the pelt. The edges 18 and 20 of the parabola are shaped with upset beads to form two channels, one on the top and one on the bottom, designated in FIG. 3 as 22 for the upper channel and 24 for the lower channel. A dam 26, generally in the shape of a V which points toward the closed end of the parabola, rises from the frame 10 to direct inflowing air from an air nozzle 28 to the top channels 22 (as shown in FIG. 1). A small amount of air flows up through a hole in air nozzle 28 through hole 30 in the frame 10, contacts the V point of the dam 26, and channels out into the channel 22. This flow of drying air dries the edges of the pelt more rapidly and helps to keep the edges from sticking to the frame. Generally, the shape of the frame, with its bead creating the upper channel 22 and the lower channel 24, helps in limiting the contact of the pelt with the frame along this portion. The reduced contact makes it easier to remove the pelt from the frame when the pelt is dried.

Figure 2:
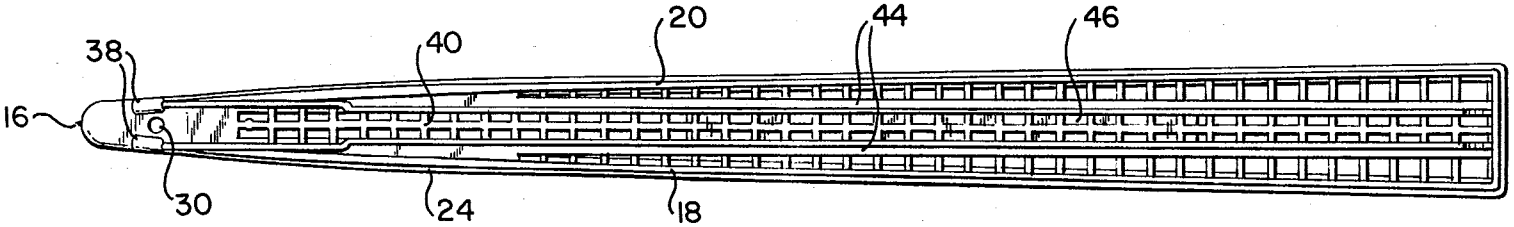
FIG. 2 shows a plan view from the bottom of a preferred pelting board.
Figure 4:
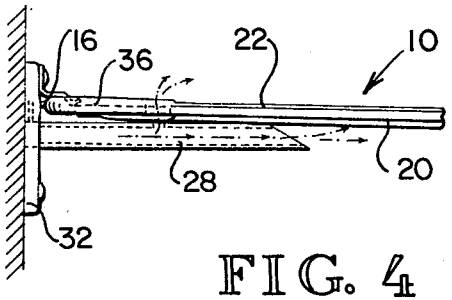
FIG. 4 is a partial side elevation of the pelting board of FIG. 1.

The closed end of the parabola for the frame 10 clips into a wall bracket 32 with a spring clip 34 which slides over an upset collar portion 36 on the frame 10. The frame rests on a flat surface on air nozzle 28 (as shown in FIG. 4). The air nozzle is confined by two stops 38 (as shown in FIG. 2). The major portion of the frame 10 between the edges 18 and 20 is made up of a lattice of longitudinal girders 40 and transverse girders 42. Preferably, the lattice is substantially uniform, because uniformity is important for attaching a pelt to the frame 10 with the tail clip 12 and the underside clip 14. As shown in the figures, two ridges 44 extend outwardly from either side of the lattice girders. These ridges 44 function to hold the pelt off of the frame 10. Thus the pelt contacts only a small portion of the surface area of the frame and, because of its limited contact, is more easily removable from the frame when the pelt is dried. The construction of the ridges is probably best understood by reference to the cross-section shown in FIG. 3.

The tail clip 12 is generally made of flexible plastic. The lattice framework of the tail clip 12 has a plurality of upset hooks extending from either side. On one side, as best seen in FIG. 1, the hooks **12*a* are spaced along the sides. Although not seen as clearly, hooks 12*b* also extend downwardly from the other side of tail clip 12; however, they project from the first inset longitudinal lattice girder. These hooks 12*b* are used to attach the tail clip 12 to the frame 10** when a female pelt is being dried.

The underside clip 14 is of similar construction to the tail clip 12, having a plurality of hooks **12*a*** which extend upwardly from one of its surfaces.

To provide further reinforcement for the frame, a plastic strip 46 may be attached to the latticework in the main body of the frame, as shown in FIG. 1.

In other respects, the mink pelting process is similar to that described in U.S. Pat. No. 3,313,038.

We claim:

1. A pelting board for drying pelts in a fur out pelting process, capable of tautly holding a pelt about the board, and comprising a generally flat, elongated, generally parabolic, relatively narrow frame, wherein the frame has:

(a) a curved parabolic end;

(b) raised edges adapted to hold the pelt substantially out of contact with the frame except around the edges of the frame; and (c) at least one open channel on each edge adapted to allow air flow along the edge so that air is capable of directly contacting the pelt to improve pelt drying and to reduce sticking of the pelt along the edge by reducing the area of contact between the pelt and the frame.

2. A pelting board for drying pelts in a fur out pelting process, capable of tautly holding a pelt about the board, and comprising a generally flat, elongated, generally parabolic, relatively narrow frame, wherein the frame has:

(a) a curved parabolic end;

(b) raised edges adapted to hold the pelt substantially out of contact with the frame except around the edges of the frame;

(c) at least one channel on each edge adapted to allow airflow along the edge so that air is capable of contacting the pelt to improve pelt drying and to reduce sticking of the pelt along the edge by reducing the area of contact between the pelt and the frame; and (d) a lattice of girders between the edges to allow airflow over substantially the entire inner surface of the pelt, wherein the lattice further has a plurality of raised ridges to reduce the surface contact between the pelt and the frame.

3. The pelting board of claim 2 wherein the lattice has a substantially uniform pattern between lattice girders.

4. The pelting board of claim 2 wherein the frame is substantially nonabsorbent to the natural fluids of pelt drying.

5. The pelting board of claim 4 wherein the frame is injection-molded plastic.

6. A pelting board for drying pelts in a fur out pelting process, capable of tautly holding a pelt about the board, and comprising a generally flat, elongated, generally parabolic, relatively narrow frame, wherein the frame has:

(a) a curved parabolic end;

(b) raised edges adapted to hold the pelt substantially out of contact with the frame except around the edges of the frame;

(c) at least one channel on each edge adapted to allow airflow along the edge so that air is capable of contacting the pelt to improve pelt drying and to reduce sticking of the pelt along the edge by reducing the area of contact between the pelt and the frame;

(d) a lattice of girders between the edges to allow airflow over substantially the entire inner surface of the pelt;

(e) a clip capable of being hooked onto the lattice girders of the frame to hold the underside of the pelt; and (f) a clip capable of being hooked onto the lattice girders of the frame to hold the tail of the pelt.

7. The pelt board of claim 6 wherein the clip for the tail is reversible to fit a female tail on one side and a male tail on the other.

8. A pelting board for drying pelts in a fur out pelting process, capable of tautly holding a pelt about the board, and comprising a generally flat, elongated, generally parabolic, relatively narrow frame, wherein the frame has:

(a) a curved parabolic end;

(b) raised edges adapted to hold the pelt substantially out of contact with the frame except around the edges of the frame;

(c) at least one channel on each edge adapted to allow airflow along the edge so that air is capable of contacting the pelt to improve pelt drying and to reduce sticking of the pelt along the edge by reducing the area of contact between the pelt and the frame; and (d) a dam to direct air for drying to the channels, wherein the dam is V-shaped with the V-point facing the parabolic end of the frame.

9. The pelting board of claim 8 wherein the lattice further has a plurality of raised ridges to reduce the surface contact between the pelt and the frame.

10. The pelting board of claim 9 wherein the frame further has a point at its parabolic end to hold the head of the pelt in position on the frame.

11. A pelting board for drying pelts in a fur out pelting process, capable of tautly holding a pelt about the board, and comprising:

(a) a generally flat, elongated, relatively narrow, substantially nonabsorbent, generally parabolic frame, having (1) channels along edges of the frame, (2) a dam to direct inlet air for drying to channels along edges of the frame, and (3) a lattice of girders between the edges of the frame to allow airflow over substantially the entire inner surface of the pelt;

(b) a clip capable of being hooked onto the lattice girders of the frame to hold the underside of the pelt without clamping the pelt while accommodating shrinkage; and (c) a clip capable of being hooked onto the lattice girders of the frame to hold the tail of the pelt without clamping the tail while accommodating shrinkage, wherein the channels are adapted to allow air flow along the edges in contact with the pelt to improve pelt drying and to reduce sticking of the pelt to the frame.

12. A pelting board for drying pelts in a fur out pelting process, capable of tautly holding a pelt about the board, and comprising a generally flat, elongated, generally parabolic, relatively narrow frame, wherein the frame has:

(a) a curved parabolic end;

(b) raised edges adapted to hold the pelt substantially out of contact with the frame except around the edges of the frame;

(c) at least one channel on each edge adapted to allow airflow along the edge so that air is capable of contacting the pelt to improve pelt drying and to reduce sticking of the pelt along the edge by reducing the area of contact between the pelt and the frame;

(d) a lattice of girders between the edges to allow airflow over substantially the entire inner surface of the pelt; and (e) a plurality of slits in the raised edges to allow airflow between the channels and the lattice.

13. A pelting board for drying pelts in a fur out pelting process, capable of tautly holding a pelt about the board, and comprising a generally flat, elongated, generally parabolic, relatively narrow frame, wherein the frame has:

(a) a curved parabolic end;

(b) raised edges adapted to hold the pelt substantially out of contact with the frame except around the edges of the frame; and (c) at least one channel on each edge adapted to allow airflow along the edge so that air is capable of contacting the pelt to improve pelt drying and to reduce sticking of the pelt along the edge by reducing the area of contact between the pelt and the frame;

wherein each edge has substantially colinear beams rising above and below the frame near the outside of the frame to define three-point contact of the pelt with the frame at the edge and to define similar air channels above and below the frame.

14. The pelting board of claim 13 wherein the frame further includes a point at the curved parabolic end to hold the head of the pelt in position on the frame.

15. The pelting board of claim 13, further comprising a plurality of slits in the beams, at least one slit above and one slit below the frame on each edge to allow air to enter the similar channels along each edge.

* * * * *